US009155428B2

(12) United States Patent
Haworth

(10) Patent No.: US 9,155,428 B2
(45) Date of Patent: Oct. 13, 2015

(54) TOILETRIES DISPENSING DEVICE AND METHOD FOR REPLACING A PLURALITY OF DISPENSING BOTTLES

(75) Inventor: Kenneth Raymond Haworth, Walnut Creek, CA (US)

(73) Assignee: WE CAN DO THAT INCORPORATED, Lafayette, CA (US)

( * ) Notice: Subject to any disclaimer, the term of this patent is extended or adjusted under 35 U.S.C. 154(b) by 332 days.

(21) Appl. No.: 12/960,338

(22) Filed: Dec. 3, 2010

(65) Prior Publication Data

US 2011/0132930 A1 Jun. 9, 2011

Related U.S. Application Data

(60) Provisional application No. 61/266,446, filed on Dec. 3, 2009.

(51) Int. Cl.

| | |
|---|---|
| ***B67D 7/84*** | (2010.01) |
| ***A47K 5/12*** | (2006.01) |
| *B05B 11/00* | (2006.01) |

(52) U.S. Cl.

CPC ..... *A47K 5/12* (2013.01); *A47K 2201/00* (2013.01); *B05B 11/30* (2013.01); *Y10T 29/49826* (2015.01)

(58) Field of Classification Search

USPC ..... 222/129, 321.1, 321.7–321.9, 153.01, 222/153.09, 180, 181.1–181.3, 132, 135, 222/383.1, 383.3, 153.03, 153.04; 29/428

See application file for complete search history.

(56) References Cited

U.S. PATENT DOCUMENTS

| | | | | | |
|---|---|---|---|---|---|
| 2,583,688 | A | * | 1/1952 | Dobkin | 222/153.03 |
| 3,349,967 | A | * | 10/1967 | Schneller | 222/130 |
| 3,540,630 | A | * | 11/1970 | Brown et al. | 222/153.03 |
| 3,990,611 | A | * | 11/1976 | Sojka | 222/135 |
| 4,582,227 | A | * | 4/1986 | Kanfer | 222/153.09 |
| 4,615,476 | A | * | 10/1986 | Hobbs et al. | 222/153.09 |
| 4,651,902 | A | * | 3/1987 | Hobbs et al. | 222/153.09 |
| 4,793,517 | A | * | 12/1988 | Washut | 222/129 |
| 5,480,068 | A | * | 1/1996 | Frazier et al. | 222/153.03 |
| 5,632,418 | A | * | 5/1997 | Brown | 222/180 |
| 5,842,601 | A | * | 12/1998 | Pierpoint | 222/1 |
| 5,992,698 | A | * | 11/1999 | Copeland et al. | 222/180 |
| 6,041,971 | A | * | 3/2000 | Pineda | 222/135 |
| 6,041,974 | A | * | 3/2000 | Poitras et al. | 222/180 |
| 7,527,171 | B2 | * | 5/2009 | Ophardt et al. | 222/80 |
| 8,100,297 | B1 | * | 1/2012 | Anish et al. | 222/153.03 |
| 2006/0086916 | A1 | * | 4/2006 | Falls | 251/91 |
| 2009/0114679 | A1 | * | 5/2009 | Ophardt et al. | 222/105 |

* cited by examiner

*Primary Examiner* — Donnell Long

(74) *Attorney, Agent, or Firm* — Law Office of Dorian Cartwright

(57) ABSTRACT

The present invention is a toiletries dispensing device with a back plate that supports a non-evasive means for mounting the toiletries dispensing device on a wall or other vertical mounting surface, a plurality of dispensing bottles with a pump disposed on top of each dispensing bottle to dispense toiletries as desired by a user, a flange assembly with a top surface and a removable section with a plurality of attachment tabs, a stationary section with a plurality of receiving slots and a plurality of pump apertures that hold and secure the dispensing bottles. There is also a mountable lock to lock the dispensing bottles in place and a bottom support surface with a smooth surfacing that the dispensing bottles are set on. There is also a method for replacing the dispensing bottles as well.

17 Claims, 7 Drawing Sheets

TOILETRIES DISPENSING DEVICE AND METHOD FOR REPLACING A PLURALITY OF DISPENSING BOTTLES

This application claims priority to U.S. Provisional Application 61/266,446 filed on Dec. 3, 2009, the entire disclosure of which is incorporated by reference.

TECHNICAL FIELD & BACKGROUND

The present invention generally relates to a dispensing device. More specifically, the invention is a toiletries dispensing device and a method for replacing a plurality of dispensing bottles in a toiletries dispensing device.

It is an object of the invention to provide a toiletries dispensing device for a lockable tamper resistant way to provide shower and bath amenities and toiletries to users of shower and bath facilities.

It is an object of the invention to provide a toiletries dispensing device with a lockable mount that uniquely allows for pumps from a plurality of dispensing bottles to extend through a top flange of the toiletries station device, keeping the bottles unexposed to tampering, but still leaving a large area on the bottles for branding and an opportunity to change the dispensing bottles' color, style and aesthetic appearance.

It is an object of the invention to provide a toiletries dispensing device that has a smooth back plate that can be mounted without damage to any vertical mounting surface by utilizing double sided tape or other non-evasive means for mounting the toiletries dispensing device.

It is an object of the invention to provide a toiletries dispensing device that has a mountable lock that keeps a plurality of dispensing bottles in place while allowing only authorized persons access to the dispensing bottles.

What is needed is a toiletries dispensing device and a method for replacing dispensing bottles in a toiletries dispensing device that includes a lockable tamper resistant way to provide shower and bath amenities to users of shower and bath facilities, a lockable mount that uniquely allows for pumps from a plurality of dispensing bottles to extend through a top flange of the toiletries station device, keeping the dispensing bottles unexposed to tampering, but still leaving a large area on the dispensing bottles for branding and opportunity to change the dispensing bottles' color, style and aesthetic appearance, that has a smooth back plate that can be mounted without damage to tile work on any bathroom surface by utilizing double sided tape instead of screws and that has a mountable lock that keeps the plurality of dispensing bottles in place while allowing only authorized persons access to the dispensing bottles.

BRIEF DESCRIPTION OF THE DRAWINGS

The present invention will be described by way of exemplary embodiments, but not limitations, illustrated in the accompanying drawing in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
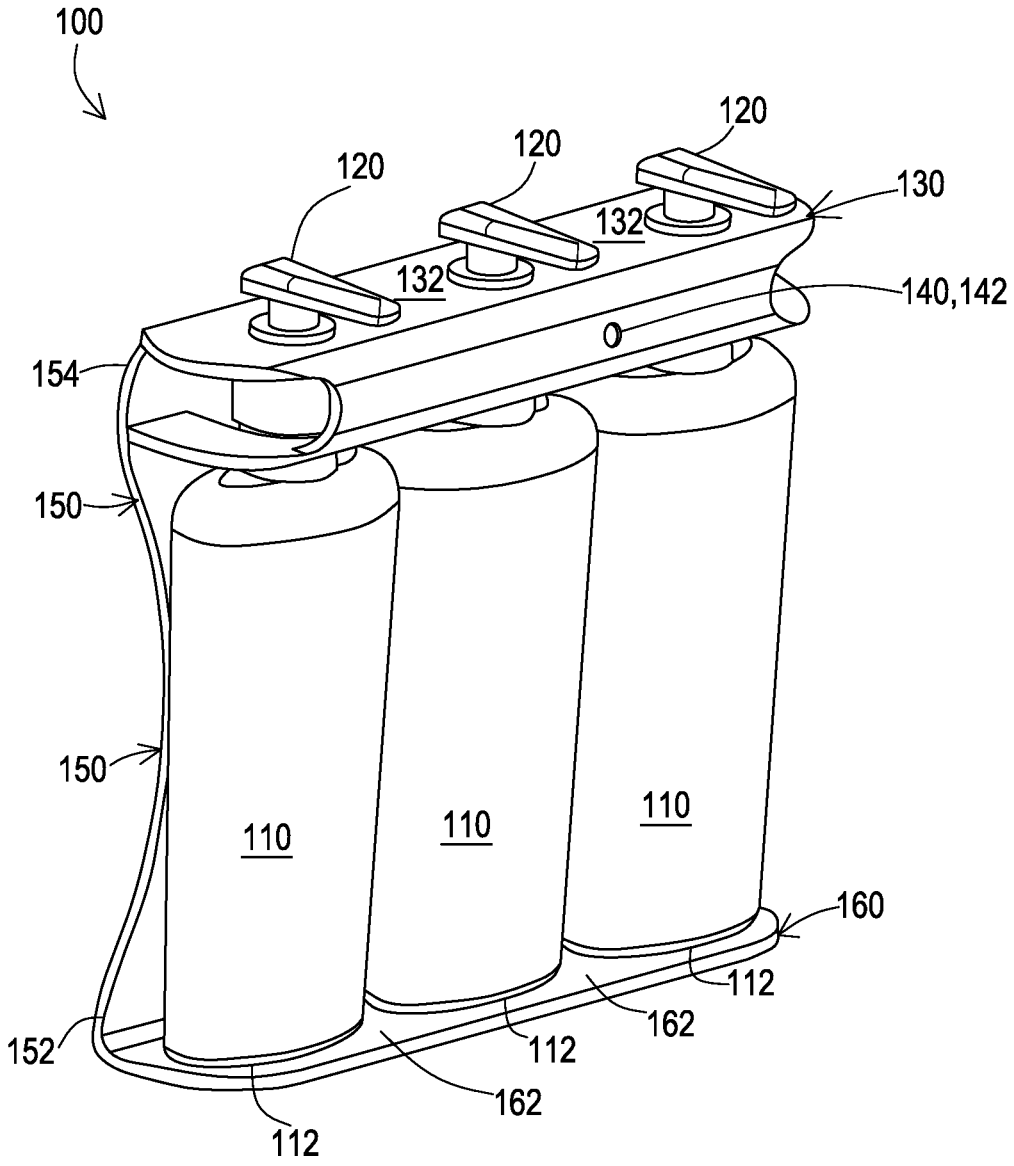
FIG. 1A illustrates a front side perspective view of a toiletries dispensing device, in accordance with one embodiment of the present invention.

FIG. 1A illustrates a front side perspective view of a toiletries dispensing device 100, in accordance with one embodiment of the present invention. The toiletries dispensing device 100 provides a lockable tamper resistant way to provide shower and bath amenities and toiletries in a plurality of dispensing bottles 110 to users of shower and bath facilities. The plurality of dispensing bottles 110 can be any number of dispensing bottles that are well known in the art that can be accommodated by the toiletries dispensing device 100, although three dispensing bottles 110 are illustrated in FIG. 1A. The toiletries dispensing device 100 can be utilized in the shower and bathroom facilities at any location, such as a hotel, a motel, a locker room or other location that is well known in the art. Each dispensing bottle 110 has a pump 120 that extends through a flange assembly 130 and a mountable lock 140 disposed on the top of the toiletries dispensing device 100. The mountable lock 140 keeps the dispensing bottles 110 in place while allowing only authorized person's access to the dispensing bottles 110. A pin stud 142 is provided and mates and engages with a pin stub aperture 144 disposed on the back plate 150 forming a secure attachment of the removable section of the flange assembly 136 with the stationary section of the flange assembly 138, as described in the FIGS. 1C and 1D descriptions. The toiletries dispensing device 100 also includes a back plate 150 that supports a non-evasive means for mounting the toiletries dispensing device 100 to a wall or other vertical surface (not shown) that is well known in the art. A bottom support surface 160 with a smooth surfacing 162, that can support the bottoms 112 of the dispensing bottles 110, is also attached to the bottom of the back plate 152. The back plate 150 can be mounted without damage to any vertical mounting surface by utilizing double sided tape (See FIG. 1C description) or other non-evasive means for mounting the toiletries dispensing device 100. The flange assembly 130 also has a top surface 132 that the pumps 120 extend above with enough room to depress the pumps 120 to comfortably dispense any toiletries (not shown) from the dispensing bottles 110.

Figure 1B:
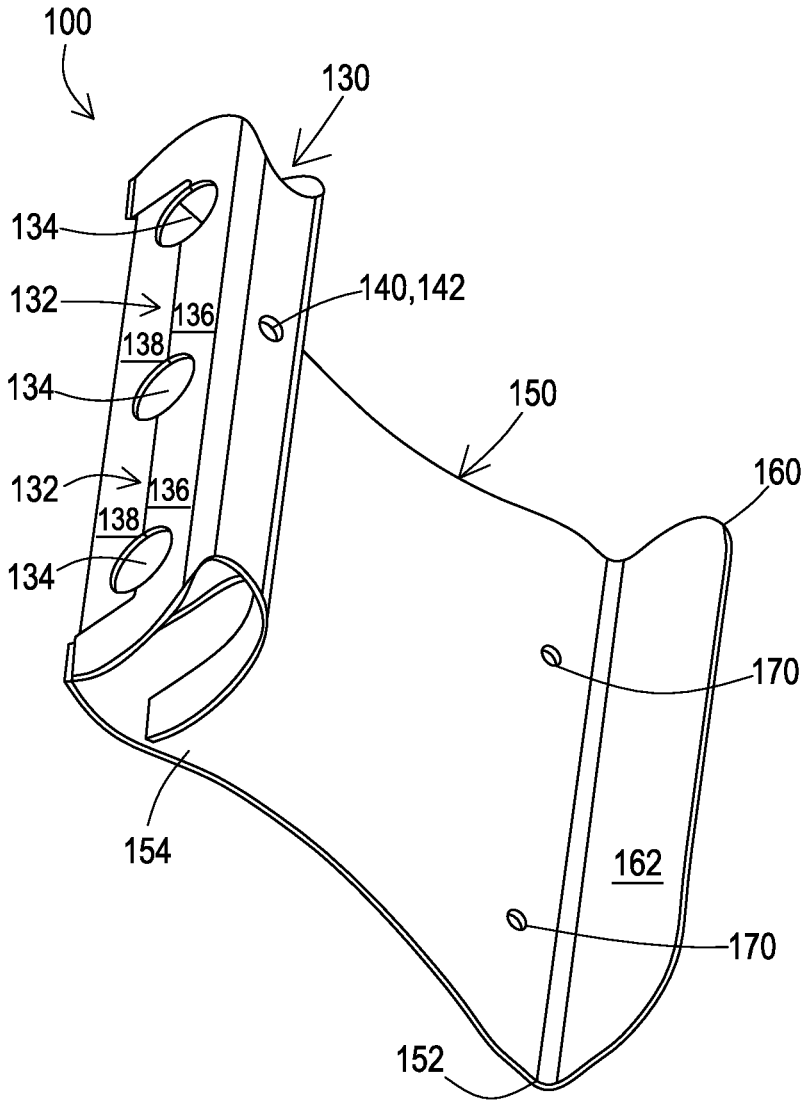
FIG. 1B illustrates a tilted front side perspective view of a toiletries dispensing device without dispensing bottles, in accordance with one embodiment of the present invention.
Figure 1C:
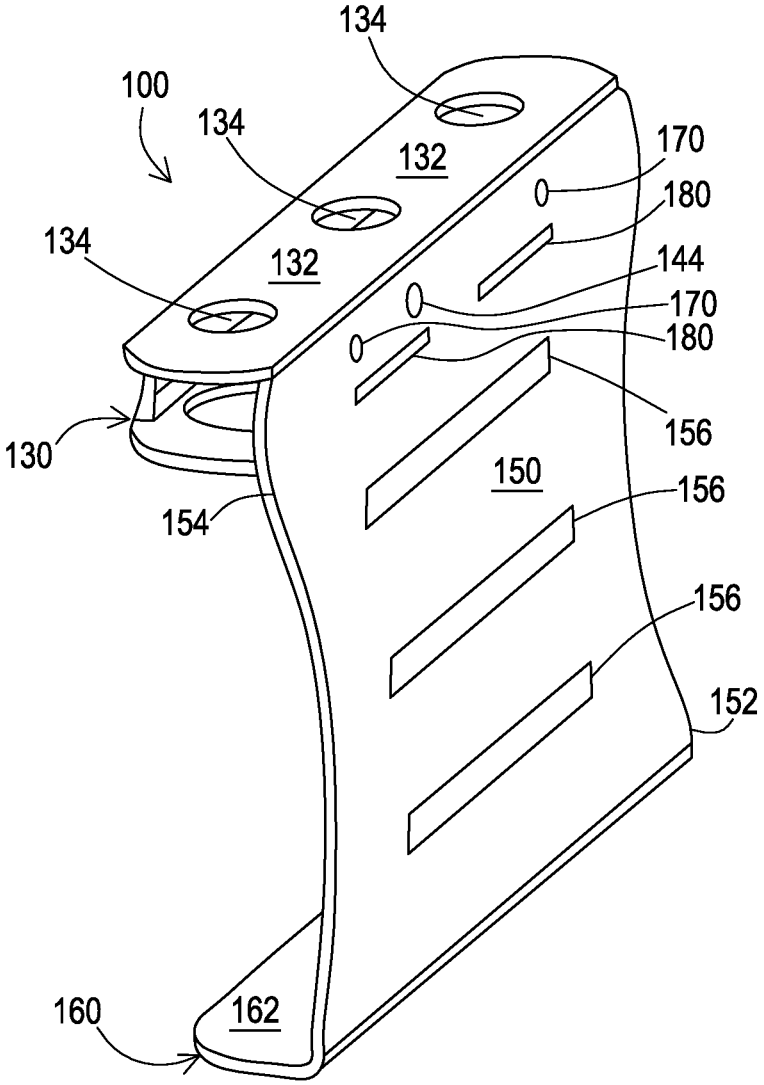
FIG. 1C illustrates a rear side perspective view of a toiletries dispensing device without dispensing bottles, in accordance with one embodiment of the present invention.
Figure 1D:
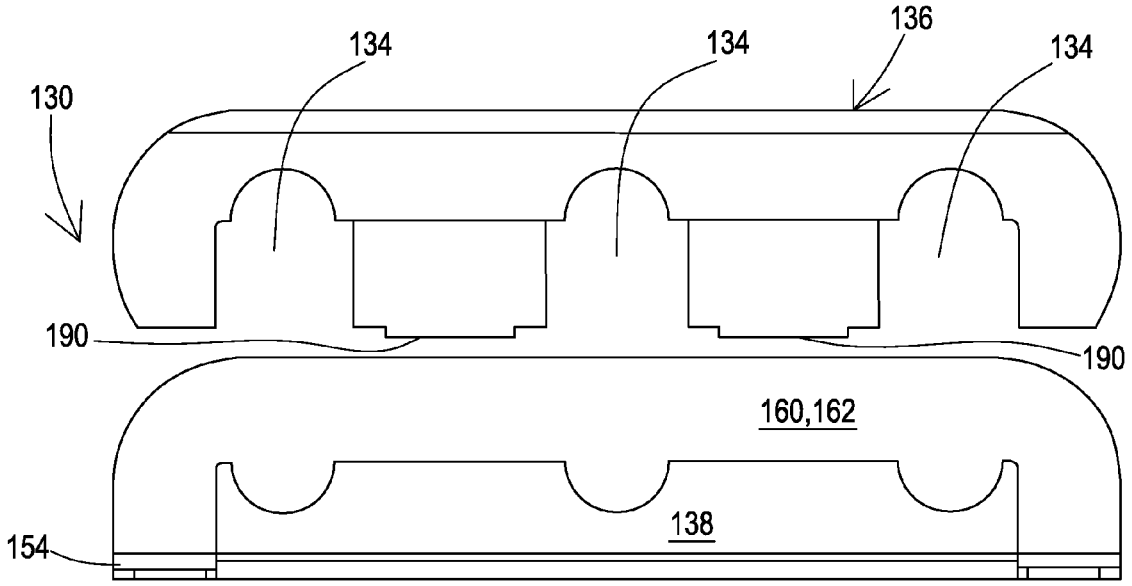
FIG. 1D illustrates an exploded overhead perspective view of a toiletries dispensing device without dispensing bottles and flange assembly, in accordance with one embodiment of the present invention.

FIG. 1B illustrates a tilted front side perspective view of a toiletries dispensing device 100 without dispensing bottles 110, in accordance with one embodiment of the present invention. FIG. 1C illustrates a rear side perspective view of a toiletries dispensing device 100 without dispensing bottles 110, in accordance with one embodiment of the present invention. FIG. 1D illustrates an exploded overhead perspective view of a flange assembly 130 of the toiletries dispensing device 100 without dispensing bottles 110, in accordance with one embodiment of the present invention.

The toiletries dispensing device 100 can be used without any included dispensing bottles 110, since any dispensing bottles 110 that are well known in the art can be used with the toiletries dispensing device 100 that can fit on the bottom support surface 160. The flange assembly 130 of the toiletries dispensing device 100 also has a plurality of pump apertures 134 to accommodate the pumps 120 from the dispensing bottles 110. The number of pump apertures 134 is always equal to or greater than the number of dispensing bottles 110, although typically a user will utilizes as many dispensing bottles 110 as possible that the number of pump apertures 134 will accommodate. There is also a plurality of mounting apertures 170 that are disposed on the back plate 150 to accommodate any protruding screws, bolts, hooks or other protruding fastening non-evasive means for mounting the toiletries dispensing device 100 already existing on a wall or other vertical surface. Any number of mounting apertures 170 that are disposed anywhere on the back plate 150 that are well known in the art can be utilized.

FIG. 1C also illustrates two receiving slots 180 that can receive two corresponding and aligned attachment tabs 190 from a removable section 136 of the flange assembly 130 that are removably attached to the stationary section of the flange assembly 138 to form the flange assembly 130 as described in the FIG. 1D description. Any number of receiving slots 180 and attachment tabs 190 that are well known in the art can be used to form the flange assembly 130. The stationary section of the flange assembly 138 is permanently disposed on the top of the back plate 154 and forms the pump apertures 134 on the flange assembly 130. The two sided tape 156, previously mentioned in the FIG. 1A description, can be disposed anywhere as desired on the back plate 150 in any length or orientation to mount the toiletries dispensing device 100 to a wall or any vertical surface. The two sided tape 156 can also be utilized together with the mounting apertures 170 to mount the toiletries dispensing device 100 to a wall or any vertical surface.

Figure 2A:
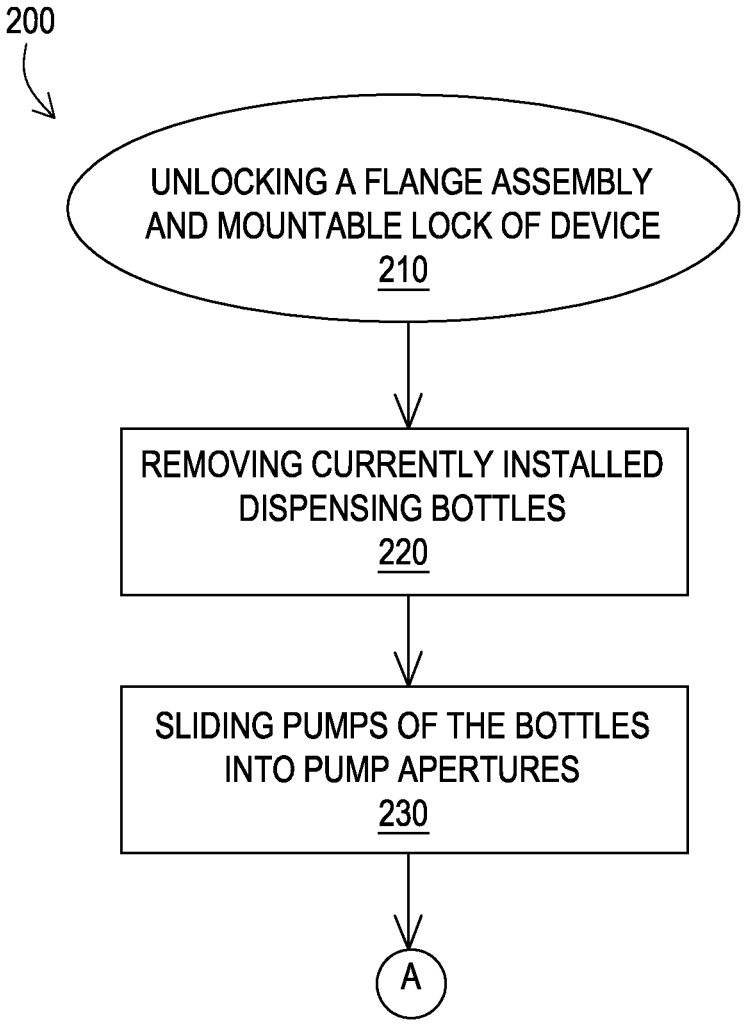
FIGS. 2A and 2B illustrate a flow chart of a method for replacing dispensing bottles in a toiletries dispensing device, in accordance with one embodiment of the present invention.
Figure 2B:
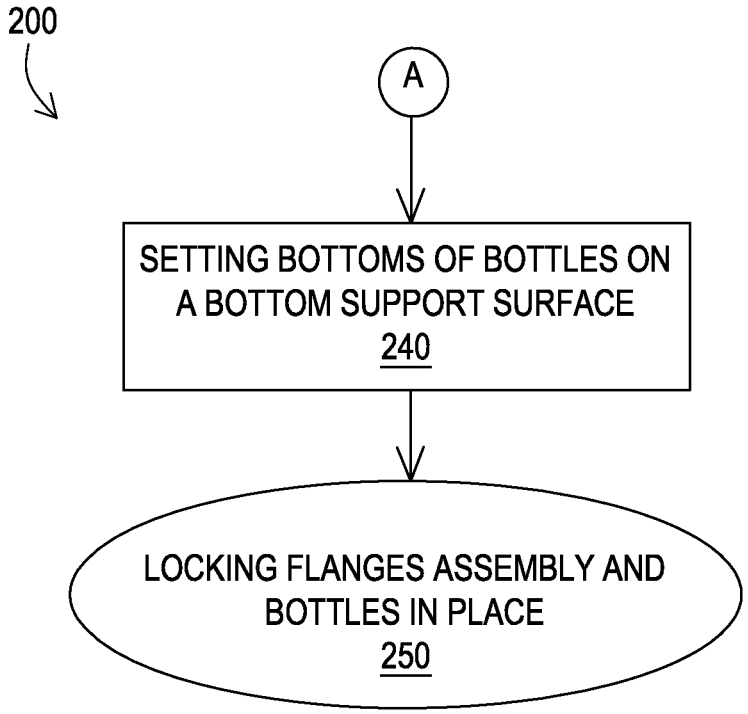

FIGS. 2A and 2B illustrate a flow chart of a method for replacing dispensing bottles in a toiletries dispensing device 200, in accordance with one embodiment of the present invention. The steps of the method for replacing dispensing bottles in a toiletries dispensing device 200 include unlocking a flange assembly and a mountable lock of the device 210, removing the currently installed dispensing bottles 220, sliding pumps of the new dispensing bottles into pump apertures 230, setting a bottom of the dispensing bottles on a bottom support surface 240 and locking the flange assembly and dispensing bottles in place 250. The toiletries dispensing device and dispensing bottles have the same components and features as described in the FIGS. 1A, 1B, 1C and 1D descriptions.

Each dispensing bottle has a pump that extends through a flange assembly and a mountable lock. The mountable lock keeps the dispensing bottles in place while allowing only authorized person's access to the dispensing bottles. A pin stud is provided for each dispensing bottle and secures each dispensing bottle by mating with a pin stub aperture disposed on the back plate forming a secure attachment of the removable section of the flange assembly with the stationary section of the flange assembly. The toiletries dispensing device also includes a back plate that supports a non-evasive means for mounting the toiletries dispensing device to a wall or other vertical surface (not shown) that is well known in the art. A bottom support surface which has a smooth surfacing that can accommodate the bottoms of any dispensing bottles is also attached to the bottom of the back plate. For example, as shown in FIG. 1A, while each dispensing bottle 110 is secured within a corresponding pump aperture of the flange assembly 130 by the pin stud 142, the bottom support surface 160 is configured to provide support, as the pump 120 of each dispensing bottle 110 is depressed by a user to dispense toiletries, to an entirety of the bottom 112 of each dispensing bottle 110. The back plate can be mounted without damage to any vertical mounting surface by utilizing double sided tape or other non-evasive means for mounting the toiletries dispensing device. The flange assembly and mountable lock is attached to the top of the back plate. The flange assembly also has a top surface where the pump sections extend above with enough room to depress the pump to comfortably dispense any toiletries (not shown) from the dispensing bottles.

Figure 3:
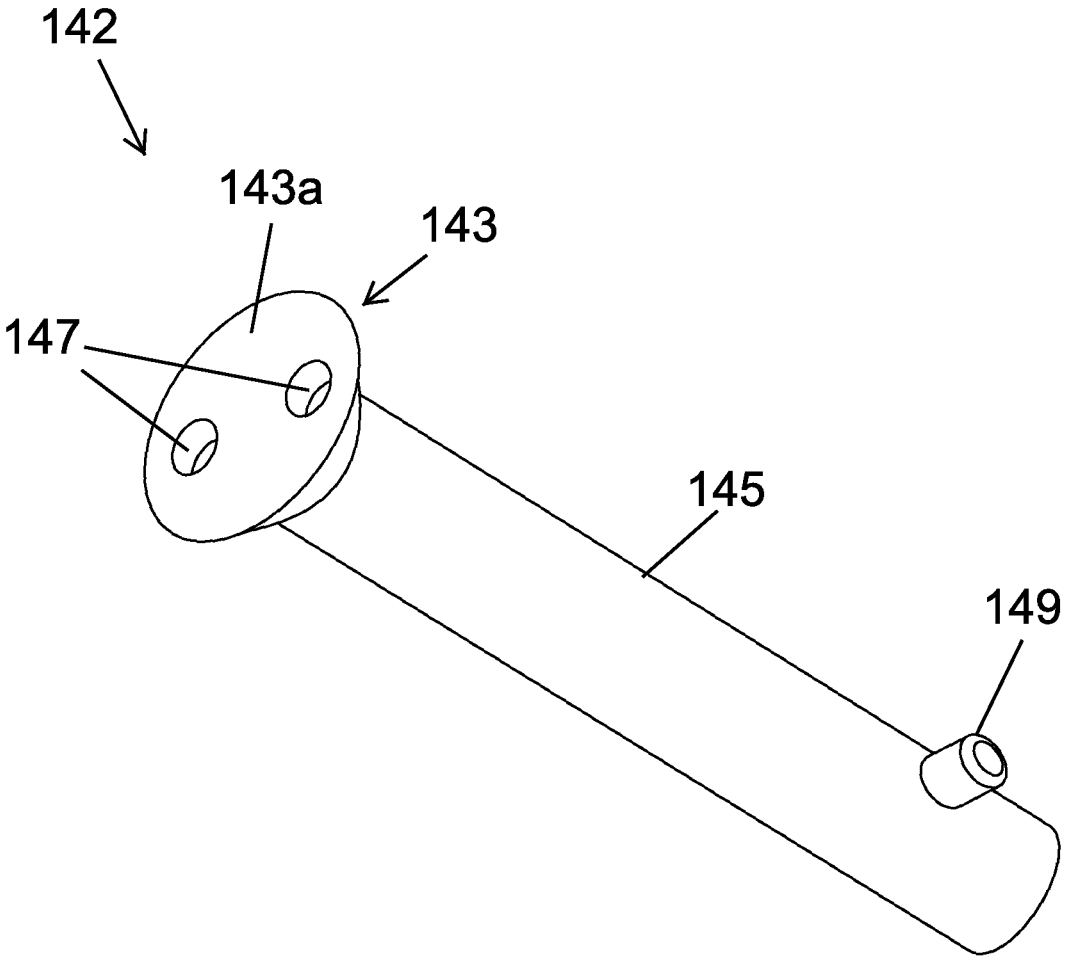
FIG. 3 illustrates a perspective view of a pin stud, in accordance with one embodiment of the present invention.

FIG. 3 shows a pin stud 142, in accordance with one embodiment of the present invention.

The pin stud 142 can have a raised head 143 and a shaft 145. The raised head 143 can include a pair of apertures 147 disposed on a top portion 143*a* of the raised head 143. The raised head 143 can also flare outward to help avoid tampering and removal of the pin stud 142. The pair of apertures 147 can help avoid tampering and removal of the pin stud 142, since the pin stud 142 can only be removed with a spanner tool (not shown) designed to accommodate the pair of apertures 147. The shaft 145 can include a horizontal protrusion 149 extending from the shaft 145 that can help secure the pin stud 142 when the pin stud 142 is inserted into the pin stub aperture 144.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A toiletries dispensing device configured to support dispensing of toiletries from a dispensing bottle not initially included with the toiletries dispensing device, wherein the dispensing bottle (i) has a bottom, and (ii) includes a pump through which the toiletries is dispensed as desired by a user, the toiletries dispensing device comprising:

a back plate with a top, a bottom, a plurality of receiving slots, and a pin stud aperture, wherein the back plate supports a non-evasive means for mounting the toiletries dispensing device on a wall or other vertical mounting surface;

a flange assembly located at the top of the back plate, wherein the flange assembly includes (i) a stationary section that is permanently disposed on the top of the back plate, (ii) a removable section that is slidably attached to the stationary section of the flange assembly, wherein the removable section of the flange assembly includes a plurality of attachment tabs, and wherein the plurality of receiving slots of the back plate are correspondingly aligned to receive the plurality of attachment tabs of the removable section of the flange assembly while the removable section of the flange assembly is attached to the stationary section of the flange assembly, and (iii) a pump aperture configured to accommodate the pump of the dispensing bottle;

a mountable lock integral to the removable section of the flange assembly, wherein the mountable lock comprises a pin stud, wherein the pin stud, while the removable section of the flange assembly is attached to the stationary section of the flange assembly, mates and engages with the pin stud aperture on the back plate to:

(i) lock the removable section of the flange assembly to the stationary section of the flange assembly, and (ii) secure, within the pump aperture of the flange assembly, the dispensing bottle; and a bottom support surface attached to the bottom of the back plate, wherein while the dispensing bottle is secured within the pump aperture of the flange assembly by the pin stud, the bottom support surface is configured to provide support, as the pump is depressed by the user to dispense the toiletries, to an entirety of the bottom of the dispensing bottle.

2. The toiletries dispensing of claim 1, wherein the non-evasive means for mounting is double-sided tape or a plurality of mounting apertures.

3. The toiletries dispensing device of claim 1, wherein the non-evasive means for mounting comprises double-sided tape and a plurality of mounting apertures.

4. The toiletries dispensing device of claim 3, wherein the mounting apertures accommodate protruding screws, bolts, hooks, or other protruding fasteners already existing on the wall or other vertical mounting surface.

5. The toiletries dispensing device of claim 1, wherein the pin stud comprises a raised head that includes a pair of apertures disposed on a top portion of the raised head.

6. The toiletries dispensing device of claim 1, wherein the pin stud comprises a shaft that includes a horizontal protrusion extending from the shaft that locks the removable section of the flange assembly to the stationary section of the flange assembly when the pin stud is engaged with the pin stub aperture.

7. The toiletries dispensing device of claim 1, wherein:

the dispensing bottle not initially included with the toiletries dispensing device comprises an aesthetic appearance; and the aesthetic appearance of the dispensing bottle not initially included with the toiletries dispensing device is visible while the dispensing bottle not initially included with the toiletries dispensing device is secured within the pump aperture of the flange assembly by the pin stud.

8. The toiletries dispensing device of claim 1, wherein:

the flange assembly comprises a second pump aperture configured to accommodate a pump of a second dispensing bottle not initially included with the toiletries dispensing device, wherein the second dispensing bottle includes a bottom; and the bottom support surface is configured to provide support also to an entirety of the bottom of the second dispensing bottle as the pump of the second dispensing bottle is depressed by the user to dispense toiletries from the second dispensing bottle.

9. The toiletries dispensing device of claim 1, wherein a first portion of the pump aperture is formed by the stationary section of the flange assembly, and a second portion of the pump aperture is formed by the removable section of the flange assembly.

10. A method for placing a dispensing bottle in a toiletries dispensing device, wherein the dispensing bottle is not initially included with the toiletries dispensing device and further includes (i) a bottom, and (ii) a pump through which the toiletries is dispensed as desired by a user and (ii), and wherein the toiletries dispensing device includes (i) a back plate, (ii) a flange assembly including (a) a stationary section that is permanently disposed on the top of the back plate and (b) a removable section that is removably attached to the stationary section of the flange assembly, (iii) a pump aperture configured to accommodate the pump of the dispensing bottle, wherein a first portion of the pump aperture is formed by the stationary section of the flange assembly, and a second portion of the pump aperture is formed by the removable section of the flange assembly, and (iv) a bottom support surface attached to the bottom of the back plate, the method comprising:

removing the removable section of the flange assembly from the stationary section of the flange assembly;

sliding the pump of the dispensing bottle into the first portion of the pump aperture formed by the stationary section of the flange assembly;

setting the dispensing bottle on the bottom support surface; and attaching the removable section of the flange assembly to the stationary section of the flange assembly such that the second portion of the pump aperture formed by the removable section of the flange assembly adjoins the first section of the pump aperture formed by the stationary section of the flange assembly to secure the dispensing bottle within the pump aperture, wherein while the dispensing bottle is secured within the pump aperture of the flange assembly, the bottom support surface is configured to provide support, as the pump is depressed by the user to dispense the toiletries, to an entirety of the bottom of the dispensing bottle.

11. The method of claim 10, wherein a non-evasive means for mounting the toiletries dispensing device to a vertical mounting surface is utilized.

12. The method of claim 11, wherein the non-evasive means for mounting is double-sided tape or a plurality of mounting apertures.

13. The method of claim 11, wherein the non-evasive means for mounting comprises double-sided tape and a plurality of mounting apertures.

14. The method of claim 13, wherein the mounting apertures accommodate protruding screws, bolts, hooks, or other protruding fasteners on the vertical mounting surface.

15. The method of claim 10, wherein:

the removable section of the flange assembly comprises a mountable lock; and attaching the removable section of the flange assembly to the stationary section of the flange assembly comprises locking the removable section of the flange assembly to the stationary section of the flange assembly.

16. The method of claim 15, wherein:

the mountable lock comprises a pin stud; and the pin stud mates and engages with a pin stud aperture disposed on the back plate to lock the removable section of the flange assembly to the stationary section of the flange assembly.

17. A toiletries dispensing device with a pin stud to facilitate access for changing a plurality of dispensing bottles, the toiletries dispensing device comprising:

a back plate with a top, a bottom, a plurality of receiving slots, and a pin stud aperture, wherein the back plate supports a non-evasive means for mounting the toiletries dispensing device on a wall or other vertical mounting surface;

an upper flange assembly comprising:

a plurality of pump apertures to accommodate exposure of a portion of each of a plurality of pumps of the plurality of dispensing bottles for users, and also covering a portion of each of the plurality of pumps of the plurality of dispensing bottles to prevent removal of any of the plurality of dispensing bottles by the users;

a slideable section mounted to the back plate in the plurality of receiving slots and secured with the pin stud engaged to a first portion of the pin stud aperture when locked, wherein the pin stud comprises a shaft with a protruding stub such that when the removable section is unlocked, the slideable section slides away from the back plate along the length of the pin stub shaft moving through to a second portion of the pin stub aperture until reaching the pin stud protruding stub, wherein the plurality of dispensing bottles are assessable for changing while unlocked, and wherein the pin stud protruding stub keeps the flange assembly connected to the back plate while the plurality of dispensing bottles are changed; and a bottom support surface attached to the bottom of the back plate, wherein while the plurality of dispensing bottles are supported both when the removable section is locked and unlocked, and wherein the bottom support accommodates the plurality of dispensing bottles that were not initially included with the toiletries dispensing device.

* * * * *